US005617056A

United States Patent [19]

Main et al.

[11] Patent Number: 5,617,056

[45] Date of Patent: Apr. 1, 1997

[54] BASE CURRENT COMPENSATION CIRCUIT

[75] Inventors: William E. Main, Mesa; David K. Lovelace, Chandler; Jesus S. Pena-Finol, Gilbert, all of Ariz.

[73] Assignee: Motorola, Inc., Schaumburg, Ill.

[21] Appl. No.: 498,038

[22] Filed: Jul. 5, 1995

[51] Int. Cl.[6] ..... G05F 1/10

[52] U.S. Cl. ..... 327/538; 323/315; 323/312

[58] Field of Search ..... 323/312, 313, 323/315; 327/362, 538, 530, 404, 542

[56] References Cited

U.S. PATENT DOCUMENTS

| | | | |
|---|---|---|---|
| 4,462,005 | 7/1984 | Kusakabe et al. | 330/288 |
| 4,475,077 | 10/1984 | Nagano | 323/315 |
| 4,591,804 | 5/1986 | van Tuijl | 330/288 |
| 5,027,014 | 1/1991 | Bass et al. | 323/315 |
| 5,079,518 | 1/1992 | Wakayama | 330/288 |
| 5,180,967 | 1/1993 | Yamazaki | 323/315 |
| 5,245,273 | 8/1993 | Greaves et al. | 323/313 |
| 5,373,253 | 12/1994 | Bailey et al. | 323/315 |

*Primary Examiner*—Timothy P. Callahan
*Assistant Examiner*—Jung Ho Kim
*Attorney, Agent, or Firm*—Rennie William Dover

[57] ABSTRACT

A base current compensation circuit (10) generates a current that tracks a gain of a transistor (11). The compensation circuit (10) includes a current mirror formed by a mirror transistor (12) and an output transistor (14). The mirror transistor (12) is connected to the transistor (11) whose gain is tracked. A current source (16) and a feedback transistor (13) causes the mirror transistor (12) to draw a base current from the transistor (11) so that a collector current of the transistor (11) matches a reference current. The output transistor (14) amplifies the base current of the transistor (11) to generate the tracking current in the collector electrode of the output transistor (14).

16 Claims, 1 Drawing Sheet

BASE CURRENT COMPENSATION CIRCUIT

BACKGROUND OF THE INVENTION

The present invention relates, in general, to generating current in an analog circuit, and more particularly, to generating a current that tracks the gain of a transistor.

In a bipolar circuit design, when a transistor is required to run at a particular current, it is often advantageous to be able to predict and supply the corresponding base current required by the transistor. The base current of the transistor can vary greatly as the transistor gain varies. The current gains of individual transistors on the same integrated circuit chip, however, are normally very close in value. Therefore, to supply the base current for one transistor, another transistor can be set to the same collector current and its base current is used to supply the first transistor. Furthermore, several transistors, used as, for example, current sources, with a common base bias can have their base currents supplied by the base current of one transistor suitably multiplied. Without such a compensating current, as more transistors are added, their cumulative base currents can load the circuit supplying the bias voltage, which causes errors in the current source values.

A high supply voltage is usually required for a circuit to generate such a tracking current. For example, a supply voltage of $2V_{BE}+V_{SAT}$, which is about 1.5 volts, is required when the circuit is comprised of bipolar transistors. It should be noted that $V_{BE}$ is the forward bias voltage across the base and emitter electrodes of a bipolar transistor and $V_{SAT}$ is the voltage across the collector and emitter electrodes of a bipolar transistor in saturation mode. However, in the portable electronic devices using a single battery cell, it is preferred for a circuit to operate at supply voltages lower than 1 volt to prolong the usable life of the battery cell.

Accordingly, it would be advantageous to have a circuit that is capable of generating a tracking current that compensates the gain of a transistor. It would be of further advantage for the circuit to operate with a low supply voltage.

DETAILED DESCRIPTION OF THE DRAWINGS

Generally, the present invention provides a current compensation circuit for generating a tracking current that tracks the gain of a transistor. More particularly, the current compensation is accomplished by using a feedback transistor to establish an equilibrium state, wherein the output current is determined by the gain of a transistor and a reference current. In addition, the feedback transistor enables the compensation circuit to operate at a supply voltage of 0.9 volts.

Figure 1:
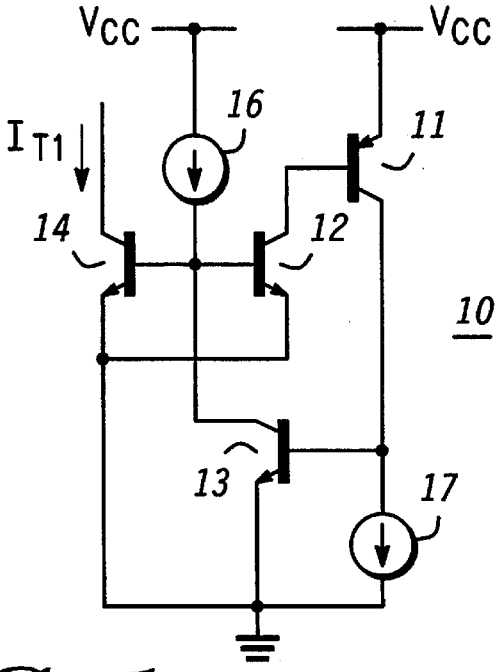
FIG. 1 illustrates a schematic diagram of a base current compensation circuit in accordance with first embodiment of the present invention.

FIG. 1 illustrates a schematic diagram of a base current compensation circuit 10, suitable for manufacture using semiconductor processing techniques, in accordance with a first embodiment of the present invention. Compensation circuit 10 comprises a PNP bipolar transistor 11 and a plurality of NPN bipolar transistors 12, 13, and 14. NPN bipolar transistors 12, 13, and 14 are also referred as mirror, feedback, and output transistors, respectively. In addition, compensation circuit 10 comprises current sources 16 and 17, which serve as current conducting elements. Current sources are well known to those skilled in the art. Compensation circuit 10 is configured such that a base electrode of transistor 11 is connected to a collector electrode of mirror transistor 12, and a collector electrode of transistor 11 is connected to a base electrode of feedback transistor 13. An emitter electrode of transistor 11 is connected to a first voltage such as, for example, a supply voltage, $V_{cc}$. A collector electrode of feedback transistor 13 is connected to the base electrodes of mirror transistor 12 and output transistor 14 and is coupled to supply voltage $V_{cc}$ via current source 16. The emitter electrodes of mirror transistor 12, output transistor 14, and feedback transistor 13 are connected to a reference potential such as, for example, a ground potential. Although the emitter electrode of feedback transistor 13 is described as being connected to the same potential as the emitter electrodes of mirror transistor 12 and output transistor 14, it should be understood that this is not a limitation of the present invention. The emitter electrode of feedback transistor 13 may be connected to a potential that is different from the potential to which the emitter electrodes of mirror transistor 12 and output transistor 14 are connected. The base electrode of feedback transistor 13 and the collector electrode of transistor 11 are coupled to a reference potential, e.g., the ground potential, via current source 17. A collector electrode of output transistor 14 is coupled for conducting a tracking current $I_{T1}$. It should be understood that the type and polarity of each transistor in compensation circuit 10 are not limited to those depicted in FIG. 1. For example, transistor 11 can be an NPN bipolar transistor, and mirror transistor 12, feedback transistor 13, and output transistor 14 can be PNP bipolar transistors. In another example, mirror transistor 12, feedback transistor 13, and output transistor 14 are field effect transistors. When interchanging bipolar transistors with field effect transistors, those skilled in the art are aware that for a bipolar transistor, a base electrode constitutes a control electrode, an emitter electrode and a collector electrode constitute current conducting electrodes; for a field effect transistor, a gate electrode constitutes a control electrode, a source electrode and a drain electrode constitute current conducting electrodes. It should be noted that mirror transistor 12 and output transistor 14 form a current mirror, and therefore, output transistor 14 should be of the same type and polarity as mirror transistor 12, i.e., if mirror transistor 12 is a bipolar transistor of polarity NPN, so is output transistor 14. Current source 16 may be comprised of a resistor.

In operation, a portion of a current provided by current source 16 is transmitted to the base electrode of mirror transistor 12, resulting in a current being generated in the collector electrode of mirror transistor 12. Transistor 11 is then activated and generates a current in its collector electrode. The collector current of transistor 11 is compared with a reference current provided by current source 17, and a difference current is generated by subtracting the reference current from the collector current of transistor 11. In response to a positive difference current, which indicates that the collector current of transistor 11 is greater than the reference current, feedback transistor 13 generates a current in its collector electrode. By drawing current from current source 16, the collector current of feedback transistor 13 reduces the portion of the current provided by current source 16 to mirror transistor 12, which further reduces the collector current of mirror transistor 12 and the collector current of transistor 11. Thus, mirror transistor 12, transistor 11, and feedback transistor 13 cooperate to form a feedback loop and set up an equilibrium state with the difference current having a substantially zero value, i.e., the collector current of transistor 11 being substantially equal to the reference current provided by current source 17. In the equilibrium state, the collector current of mirror transistor 12, which is equal to the base current of transistor 11, is inversely proportional to the gain of transistor 11 and is also determined by the reference current provided by current source 17. The collector current of output transistor 14, is in direct proportion to the collector current of mirror transistor 12, with the coefficient of proportionality equal to the emitter area ratio between the two transistors. Therefore, compensation circuit 10 generates a tracking current in the collector electrode of output transistor 14 that tracks the gain of transistor 11.

The supply voltage required by compensation circuit 10 is equal to $V_{BE}+V_{SAT}$, where $V_{BE}$ is the forward bias voltage across the base and emitter electrodes of a bipolar transistor and $V_{SAT}$ is the voltage across the collector and emitter electrodes of a bipolar transistor in saturation mode. That is, compensation circuit 10 can operate with a supply voltage of less than 0.9 volts, which is a preferred supply voltage for a portable electronic device with a single battery cell.

Figure 2:
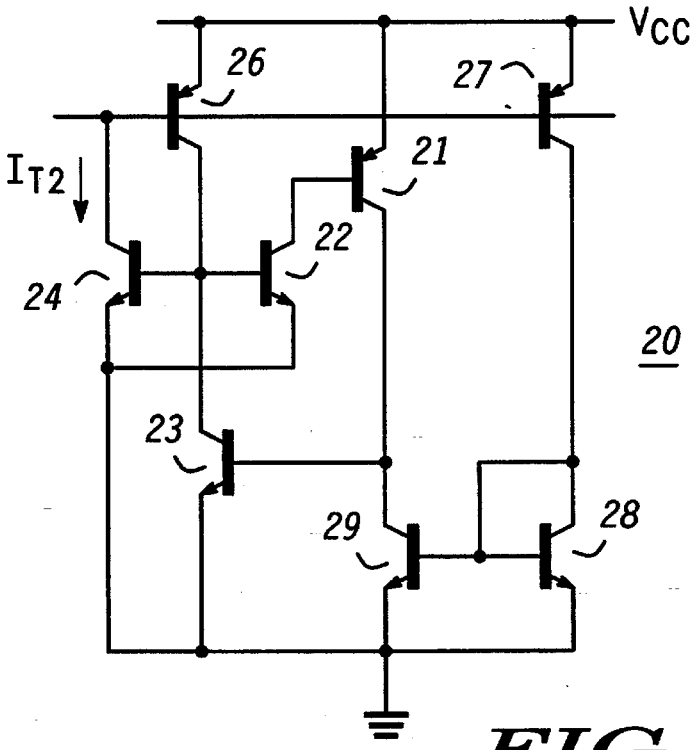
FIG. 2 illustrates a schematic diagram of a base current compensation circuit in accordance with a second embodiment of the present invention.

FIG. 2 illustrates a schematic diagram of a base current compensation circuit 20, suitable for manufacture using semiconductor process techniques, in accordance with a second embodiment of the present invention. Compensation circuit 20 comprises three PNP bipolar transistors 21, 26, and 27, and a plurality of NPN bipolar transistors 22, 23, 24, 28, and 29. PNP bipolar transistors 26 and 27 are referred as current source and input transistors, respectively. NPN bipolar transistors 22, 23, and 24 are referred as mirror, feedback, and output transistors, respectively. Compensation circuit 20 is configured such that a base electrode of transistor 21 is connected to a collector electrode of mirror transistor 22, and a collector electrode of transistor 21 is connected to a base electrode of feedback transistor 23 and to a collector electrode of transistor 29. An emitter electrode of transistor 21 is connected to a first supply terminal for receiving a supply voltage, for example, $V_{cc}$. A collector electrode of feedback transistor 23 is connected to the base electrodes of mirror transistor 22 and output transistor 24, and to a collector electrode of current source transistor 26. An emitter electrode and a base electrode of current source transistor 26 are coupled for receiving a supply voltage of, for example, $V_{cc}$, and an input voltage, respectively. The emitter electrodes of mirror transistor 22, output transistor 24, and feedback transistor 23 are connected to a second supply terminal for receiving a reference potential such as, for example, a ground potential. Although the emitter electrode of feedback transistor 23 is described as being connected to the same potential as the emitter electrodes of mirror transistor 22 and output transistor 24, it should be understood that this is not a limitation of the present invention. The emitter electrode of feedback transistor 23 can be connected to a potential that is different from the potential to which the emitter electrodes of mirror transistor 22 and output transistor 24 are connected. An emitter electrode and a base electrode of input transistor 27 are coupled for receiving a supply voltage of, for example, $V_{cc}$, and an input, respectively. A collector electrode of input transistor 27 is connected to the base and collector electrodes of transistor 28. A base electrode of transistor 29 is connected to the base electrode of transistor 28. The emitter electrodes of transistors 28 and 29 are coupled for receiving a reference potential, e.g., the ground potential. A collector electrode of output transistor 24 is coupled for conducting a tracking current $I_{T2}$. It should be understood that the type and polarity of each transistor in compensation circuit 20 are not limited to those depicted in FIG. 2. For example, transistor 21, current source transistor 26, and input transistor 27 can be NPN bipolar transistors, and mirror transistor 22, feedback transistor 23, output transistor 24, transistor 28, and transistor 29 can be PNP bipolar transistors. In another example, mirror transistor 22, feedback transistor 23, output transistor 24, transistor 28, and transistor 29 are field effect transistors. Furthermore, current source transistor 26 can be replaced by a field effect transistor or a resistor. Because mirror transistor 22 and output transistor 24 constitutes a current mirror, output transistor 24 is of the same type and polarity as mirror transistor 22, i.e., if mirror transistor 22 is a bipolar transistor of polarity NPN, so is output transistor 24. Likewise, because transistors 28 and 29 form a current mirror, they are of the same type and polarity. Transistor 21 and input transistor 27 should be of the same type and polarity as the transistors which receive a gain compensation current from compensation circuit 20.

In operation, input transistor 27 receives an input at its base electrode and generates a current in its collector electrode, which is then transmitted to the collector electrode of transistor 28. The current mirror comprised of transistors 28 and 29 generates a reference current in the collector electrode of transistor 29 that is directly proportional to the current in the collector electrode of transistor 28. The coefficient of proportionality is equal to the emitter area ratio of transistor 29 to transistor 28. The collector current of transistor 21 is adjusted to be equal to the reference current by feedback transistor 23 and current source transistor 26. Feedback transistor 23 and current source transistor 26 cause mirror transistor 22 to draw a base current from transistor 21 so that the collector current of transistor 21 matches the reference current in the collector electrode of transistor 29. Output transistor 24 and mirror transistor 22 work as a current mirror with a current gain equal to the ratio between the emitter areas of transistors 22 and 24. Thus, a tracking current is generated in the collector electrode of output transistor 24. The tracking current compensates for the gain of transistor 21 by being inversely proportional to the gain of transistor 21 and directly proportional to the collector current of input transistor 27.

The use of feedback transistor 23 allows compensation circuit 20 to operate with a minimum supply voltage of $V_{BE}+V_{SAT}$, which can be, as explained supra, less than 0.9 volts.

By now it should be appreciated that a compensation circuit for generating a tracking current has been provided. The compensation circuit generates a current that tracks a transistor current gain. Furthermore, the compensation circuit can operate with a supply voltage lower than 0.9 volts, which makes the compensation circuit suitable for low power, low voltage applications.

We claim:

1. A base current compensation circuit, comprising:

a first bipolar transistor having a base electrode, an emitter electrode, and a collector electrode, the emitter electrode coupled for receiving a first voltage;

a first current conducting element coupled to the collector electrode of the first bipolar transistor;

a first transistor having a control electrode, a first current conducting electrode, and a second current conducting electrode, the first current conducting electrode coupled for receiving a second voltage and the second current conducting electrode coupled to the base electrode of the first bipolar transistor;

a second current conducting element coupled to the control electrode of the first transistor;

a second transistor having a control electrode, a first current conducting electrode, and a second current conducting electrode, the control electrode coupled to the collector electrode of the first bipolar transistor, the first current conducting electrode coupled for receiving a third voltage, and the second current conducting electrode coupled to the control electrode of the first transistor; and a third transistor having a control electrode, a first current conducting electrode, and a second current conducting electrode, the control electrode coupled to the control electrode of the first transistor, the first current conducting electrode coupled to the first current conducting electrode of the first transistor, and the second current conducting electrode coupled for current output.

2. The base current compensation circuit of claim 1, wherein the third voltage is equal to the second voltage.

3. The base current compensation circuit of claim 1, wherein the first bipolar transistor is a PNP bipolar transistor, and the first, second, and third transistors are NPN bipolar transistors.

4. The base current compensation circuit of claim 1, wherein the first current conducting element comprises:

a third current conducting element; and a current mirror having an input terminal, an output terminal, and a common terminal, the input terminal coupled to the third current conducting element, the output terminal coupled to the collector electrode of the first bipolar transistor, and the common terminal coupled for receiving a fourth voltage.

5. The base current compensation circuit of claim 4, wherein the fourth voltage is equal to the second voltage.

6. The base current compensation circuit of claim 4, wherein the third current conducting element comprises a second bipolar transistor having a base electrode, an emitter electrode, and a collector electrode, the base electrode coupled for receiving an input, the emitter electrode coupled for receiving the first voltage, and the collector electrode coupled to the input terminal of the current mirror.

7. The base current compensation circuit of claim 6, wherein the first bipolar transistor and the second bipolar transistor are PNP bipolar transistors.

8. The base current compensation circuit of claim 4, wherein the current mirror comprises:

a fourth transistor having a control electrode, a first current conducting electrode, and a second current conducting electrode, the control electrode coupled to the input terminal of the current mirror, the first current conducting electrode coupled to the common terminal of the current mirror, and the second current conducting electrode coupled to the input terminal of the current mirror; and a fifth transistor having a control electrode, a first current conducting electrode, and a second current conducting electrode, the control electrode coupled to the control electrode of the fourth transistor, the first current conducting electrode coupled to the common terminal of the current mirror, and the second current conducting electrode coupled to the output terminal of the current mirror.

9. The base current compensation circuit of claim 8, wherein the fourth and fifth transistors are bipolar transistors.

10. The base current compensation circuit of claim 1, wherein the second current conducting element comprises a fourth transistor having a control electrode, a first current conducting electrode, and a second current conducting electrode, the control electrode coupled for receiving an input, the first current conducting electrode coupled for receiving the first voltage, and the second current conducting electrode coupled to the control electrode of the first transistor.

11. The base current compensation circuit of claim 10, wherein the fourth transistor is a bipolar transistor.

12. A base current compensation circuit having a first supply terminal and a second supply terminal, comprising:

an input transistor having a control electrode, a first current conducting electrode, and a second current conducting electrode, the control electrode coupled for receiving an input, the first current conducting electrode coupled to the first supply terminal;

a first transistor having a control electrode, a first current conducting electrode, and a second current conducting electrode, the first current conducting electrode coupled to the first supply terminal;

a current mirror having an input terminal, an output terminal, and a common terminal, the input terminal coupled to the second current conducting electrode of the input transistor, the output terminal coupled to the second current conducting electrode of the first transistor, and the common terminal coupled to the second supply terminal;

a second transistor having a control electrode, a first current conducting electrode, and a second current conducting electrode, the first current conducting electrode coupled to the second supply terminal and the second current conducting electrode coupled to the control electrode of the first transistor;

a current conducting element coupled to the control electrode of the second transistor;

a third transistor having a control electrode, a first current conducting electrode, and a second current conducting electrode, the control electrode coupled to the second current conducting electrode of the first transistor, the first current conducting electrode coupled to the second supply terminal, and the second current conducting electrode coupled to the control electrode of the second transistor; and a fourth transistor having a control electrode, a first current conducting electrode, and a second current conducting electrode, the control electrode coupled to the control electrode of the second transistor, the first current conducting electrode coupled to the first current conducting electrode of the second transistor, and the second current conducting electrode coupled for current output.

13. The base current compensation circuit of claim 12, wherein the current conducting element comprises a fifth transistor having a control electrode, a first current conducting electrode, and a second current conducting electrode, the control electrode coupled for receiving the input, the first current conducting electrode coupled to the first supply terminal, and the second current conducting electrode coupled to control electrode of the second transistor.

14. The base current compensation circuit of claim 13, wherein the input transistor, the first transistor, and the fifth transistor are PNP bipolar transistors, and the second, third, and fourth transistors are NPN bipolar transistors.

15. The base current compensation circuit of claim 12, wherein the current mirror comprises:

a sixth transistor having a control electrode, a first current conducting electrode, and a second current conducting electrode, the control electrode coupled to the input terminal of the current mirror, the first current conducting electrode coupled to the common terminal of the current mirror, and the second current conducting electrode coupled to the input terminal of the current mirror; and a seventh transistor having a control electrode, a first current conducting electrode, and a second current conducting electrode, the control electrode coupled to the control electrode of the sixth transistor, the first current conducting electrode coupled to the common terminal of the current mirror, and the second current conducting electrode coupled to the output terminal of the current mirror.

16. The base current compensation circuit of claim 15, wherein the sixth and seventh transistors are bipolar transistors.

* * * * *